US007302797B2

(12) United States Patent
Zhang et al.

(10) Patent No.: US 7,302,797 B2
(45) Date of Patent: Dec. 4, 2007

(54) HYDRAULIC SYSTEM HAVING A POST-PRESSURE COMPENSATOR

(75) Inventors: Jiao Zhang, Naperville, IL (US); Pengfei Ma, Naperville, IL (US); Michael R. Schwab, Crest Hill, IL (US)

(73) Assignees: Caterpillar Inc., Peoria, IL (US); Shin Caterpillar Mitsubishi Ltd (JP)

( * ) Notice: Subject to any disclaimer, the term of this patent is extended or adjusted under 35 U.S.C. 154(b) by 0 days.

(21) Appl. No.: 11/139,689

(22) Filed: May 31, 2005

(65) Prior Publication Data

US 2006/0266210 A1 Nov. 30, 2006

(51) Int. Cl.
*F15B 13/04* (2006.01)
*F15B 11/08* (2006.01)
*B66C 13/00* (2006.01)

(52) U.S. Cl. ..... 60/422; 91/447; 91/464

(58) Field of Classification Search ..... 60/422, 60/459; 91/446, 447, 464
See application file for complete search history.

(56) References Cited

U.S. PATENT DOCUMENTS 3,366,202 A 1/1968 James
3,987,626 A 10/1976 Bianchetta
4,046,270 A 9/1977 Baron et al.
4,222,409 A 9/1980 Budzich
4,250,794 A 2/1981 Haak et al.
4,416,187 A 11/1983 Nystrom
4,437,385 A 3/1984 Kramer et al.
4,480,527 A 11/1984 Lonnemo
4,581,893 A 4/1986 Lindbom
4,586,330 A 5/1986 Watanabe et al.
4,619,186 A 10/1986 Walters
4,623,118 A 11/1986 Kumar
4,662,601 A 5/1987 Andersson
4,706,932 A 11/1987 Yoshida et al.
4,747,335 A 5/1988 Budzich
4,799,420 A 1/1989 Budzich
5,067,519 A 11/1991 Russell et al.
5,137,254 A 8/1992 Aardema et al.
5,152,142 A 10/1992 Budzich
5,187,933 A * 2/1993 Nikolaus ..... 91/457
5,211,196 A 5/1993 Schwelm
5,249,421 A 10/1993 Lunzman (Continued)

FOREIGN PATENT DOCUMENTS

DE 198 00 721 7/1999

(Continued)

*Primary Examiner*—Thomas E. Lazo
(74) *Attorney, Agent, or Firm*—Finnegan, Henderson, Farabow, Garrett & Dunner

(57) ABSTRACT

A hydraulic system for a work machine is disclosed. The hydraulic system has a reservoir configured to hold a supply of fluid and a source configured to pressurize the fluid. The hydraulic system also has a fluid actuator, a first valve, and a second valve. The first valve is configured to selectively fluidly communicate the source with the fluid actuator to facilitate movement of the fluid actuator in a first direction. The second valve is configured to selectively fluidly communicate the fluid actuator with the reservoir to facilitate movement of the fluid actuator in the first direction. The hydraulic system further has a proportional pressure compensating valve configured to control a pressure of a fluid directed between the fluid actuator and the reservoir.

35 Claims, 2 Drawing Sheets

U.S. PATENT DOCUMENTS 5,267,441 A 12/1993 Devier et al.
5,287,794 A 2/1994 Andersson
5,297,381 A 3/1994 Eich et al.
5,305,681 A 4/1994 Devier et al.
5,313,873 A 5/1994 Gall et al.
5,350,152 A 9/1994 Hutchison et al.
5,366,202 A 11/1994 Lunzman
5,447,093 A 9/1995 Budzich
5,477,677 A 12/1995 Krnavek
5,490,384 A 2/1996 Lunzman
5,537,818 A 7/1996 Hosseini et al.
5,540,049 A 7/1996 Lunzman
5,553,452 A 9/1996 Snow et al.
5,560,387 A 10/1996 Devier et al.
5,564,673 A 10/1996 Pieren
5,568,759 A 10/1996 Aardema
5,678,470 A 10/1997 Koehler et al.
5,692,376 A 12/1997 Miki et al.
5,701,933 A 12/1997 Lunzman
5,737,993 A 4/1998 Cobo et al.
5,784,945 A 7/1998 Krone et al.
5,813,226 A 9/1998 Krone
5,813,309 A 9/1998 Taka et al.
5,857,330 A 1/1999 Ishizaki et al.
5,868,059 A 2/1999 Smith
5,878,647 A 3/1999 Wilke et al.
5,880,957 A 3/1999 Aardema et al.
5,890,362 A 4/1999 Wilke
5,947,140 A 9/1999 Aardema et al.
5,953,977 A 9/1999 Krishna et al.
5,960,695 A * 10/1999 Aardema et al. ..... 91/459
6,009,708 A 1/2000 Miki et al.
6,026,730 A 2/2000 Yoshida et al.
6,082,106 A 7/2000 Hamamoto
6,098,403 A 8/2000 Wilke
6,131,391 A 10/2000 Poorman
6,185,493 B1 2/2001 Skinner et al.
6,216,456 B1 4/2001 Mitchell
6,257,118 B1 7/2001 Wilbur et al.
6,282,891 B1 9/2001 Rockwood
6,318,079 B1 11/2001 Barber
6,367,365 B1 4/2002 Weickert et al.
6,398,182 B1 6/2002 Stephenson
6,446,433 B1 9/2002 Holt et al.
6,467,264 B1 10/2002 Stephenson et al.
6,498,973 B2 12/2002 Dix et al.
6,502,393 B1 1/2003 Stephenson et al.
6,502,500 B2 1/2003 Yoshino
6,516,614 B1 2/2003 Knoll
6,598,391 B2 7/2003 Lunzman et al.
6,619,183 B2 9/2003 Yoshino
6,655,136 B2 * 12/2003 Holt et al. ..... 60/469
6,662,705 B2 12/2003 Huang et al.
6,665,136 B2 12/2003 Clinton et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
6,843,340 B2 * 1/2005 Miller ..... 180/308
6,880,332 B2 4/2005 Pfaff et al.
7,204,084 B2 4/2007 Ma et al.
2003/0084946 A1 5/2003 Douglass et al.
2003/0121256 A1 7/2003 Mather
2003/0121409 A1 7/2003 Lunzman et al.
2003/0125840 A1 7/2003 Lunzman et al.
2003/0196545 A1 10/2003 Jensen et al.
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.
2005/0087065 A1 * 4/2005 Yoshino ..... 91/444

FOREIGN PATENT DOCUMENTS

EP 0637788 2/1995
EP 637788 A1 * 2/1995
EP 0967400 B1 12/1999
EP 1338802 8/2003
JP 02613041 B2 5/1997

* cited by examiner

HYDRAULIC SYSTEM HAVING A POST-PRESSURE COMPENSATOR

TECHNICAL FIELD

The present disclosure relates generally to a hydraulic system, and more particularly, to a hydraulic system having a post-pressure compensator.

BACKGROUND

Work machines such as, for example, dozers, loaders, excavators, motor graders, and other types of heavy machinery use one or more hydraulic actuators to accomplish a variety of tasks. These actuators are fluidly connected to a pump on the work machine that provides pressurized fluid to chambers within the actuators. An electro-hydraulic valve arrangement is typically fluidly connected between the pump and the actuators to control a flow rate and direction of pressurized-fluid to and from the chambers of the actuators.

During movement of the actuators, it may be possible for gravity acting on the work machine to force fluid from the actuator faster than fluid can fill the actuator. In this situation, a void or vacuum may be created by the expansion of a filling chamber within the actuator (voiding). Voiding can result in undesired and/or unpredictable movement of the work machine and could damage the hydraulic actuator. In addition, during these situations, it may be possible for the actuator to overspeed or move faster than expected or desired.

One method of minimizing voiding and overspeeding is described in U.S. Pat. No. 6,131,391 (the '391 patent) issued to Poorman on Oct. 17, 2000. The '391 patent describes a hydraulic circuit having a tank, a pump, a motor, four independently operable electro-hydraulic metering valves, a motor input pressure sensor, a motor output pressure sensor, and a pump supply pressure sensor. When a pressure measured at the output of the motor is greater than a pressure measured at the input of the motor and the pump supply, an overspeed condition is determined. When an overspeed condition is determined, one of the electro-hydraulic metering valves is actuated to restrict a flow of hydraulic fluid from the motor to slow rotation of the motor and the flow rate of fluid exiting the motor.

Although the hydraulic circuit described in the '391 patent may reduce the likelihood of overspeeding and voiding, it may be slow to respond and may be complex and expensive. In particular, because the mechanism for slowing the motor includes a solenoid-actuated valve, the response time of the hydraulic circuit may be on the order of 5-15 hz. With this configuration, by the time the overspeed condition is determined and counteracted, the effects of voiding or overspeeding may have already been experienced by the work machine. In addition, because the overspeed protection of the '391 patent is based on sensory information, the system may be complex. The additional sensors required to provide the sensory information may also add cost to the system.

The disclosed hydraulic system is directed to overcoming one or more of the problems set forth above.

SUMMARY OF THE INVENTION

In one aspect, the present disclosure is directed to a hydraulic system. The hydraulic system includes a reservoir configured to hold a supply of fluid and a source configured to pressurize the fluid. The hydraulic system also includes a fluid actuator, a first valve, and a second valve. The first valve is configured to selectively fluidly communicate the source with the fluid actuator to facilitate movement of the fluid actuator in a first direction. The second valve is configured to selectively fluidly communicate the fluid actuator with the reservoir to facilitate movement of the fluid actuator in the first direction. The hydraulic system further includes a proportional pressure compensating valve configured to control a pressure of a fluid directed between the fluid actuator and the reservoir.

In another aspect, the present disclosure is directed to a method of operating a hydraulic system. The method includes pressurizing a fluid and directing the pressurized fluid to a fluid actuator via a first valve to facilitate movement of the fluid actuator in a first direction. The method further includes draining fluid from the fluid actuator via a second valve to facilitate movement of the fluid actuator in the first direction. The method also includes controlling a pressure of the fluid drained from the actuator with a proportional pressure compensating valve.

DETAILED DESCRIPTION

Figure 1:
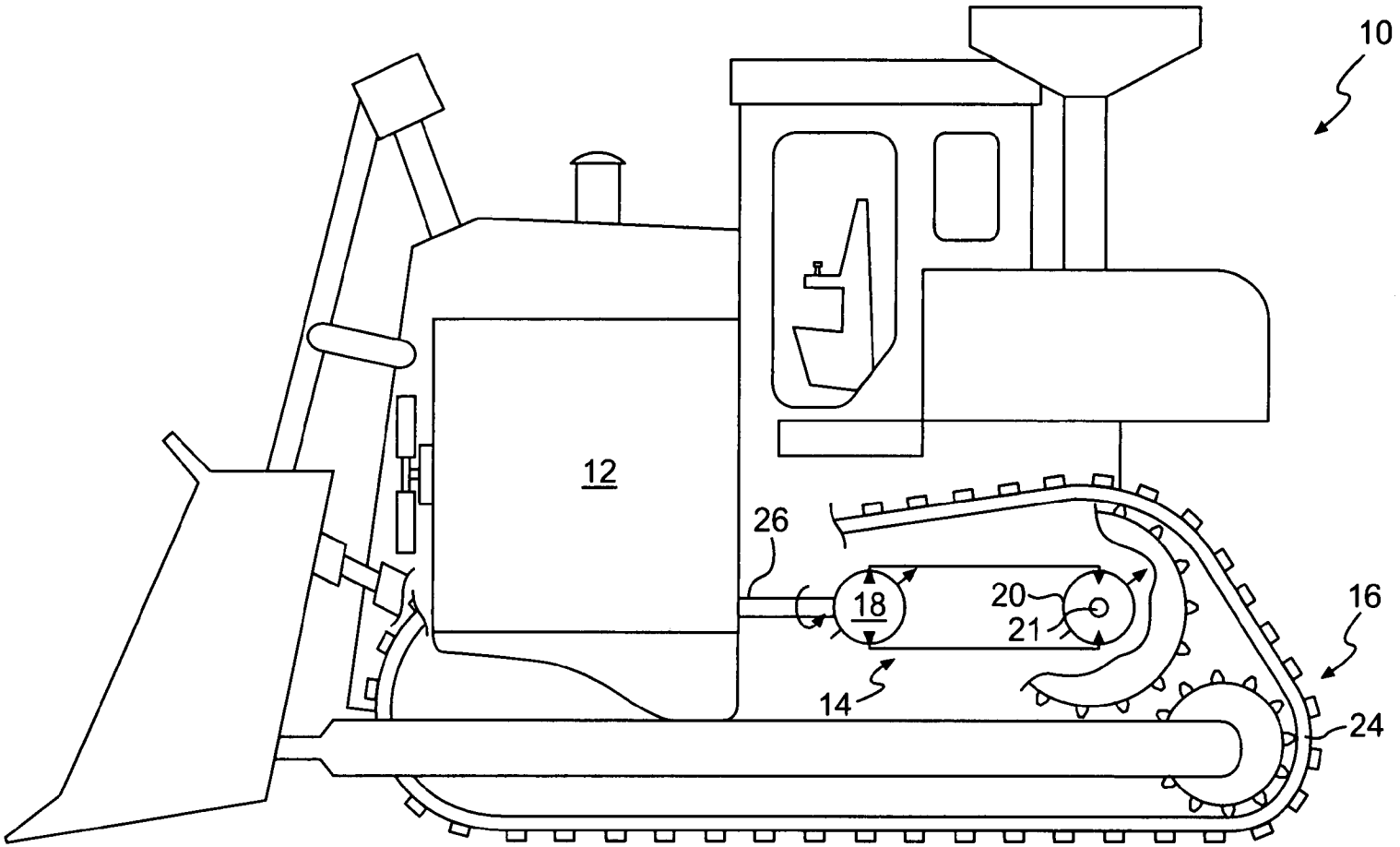
FIG. 1 is a side-view diagrammatic illustration of a work machine according to an exemplary disclosed embodiment.

FIG. 1 illustrates an exemplary work machine 10. Work machine 10 may be a machine that performs some type of operation associated with an industry such as mining, construction, farming, or any other industry known in the art. For example, work machine 10 may be an earth moving machine such as a dozer, a loader, a backhoe, an excavator, a motor grader, a dump truck, or any other earth moving machine. Work machine 10 may include a power source 12 and a transmission 14 connected to drive a plurality of traction devices 16 (only one shown in FIG. 1).

Power source 12 may be an engine such as, for example, a diesel engine, a gasoline engine, a gaseous fuel-powered engine such as a natural gas engine, or any other engine apparent to one skilled in the art. Power source 12 may also include other sources of power such as a fuel cell, a power storage device, or any other source of power known in the art.

Transmission 14 may be a hydrostatic transmission for transmitting power from power source 12 to traction device 16. A hydrostatic transmission generally consists of a pump 18, a motor 20, and a ratio controller (not shown). The ratio controller may manipulate the displacement of pump 18 and motor 20 to thereby control the output rotation of transmission 14. Motor 20 may be fluidly connected to pump 18 by conduits that supply and return fluid to and from the pump 18 and motor 20, allowing pump 18 to effectively drive motor 20 by fluid pressure. It is contemplated that work machine 10 may include more than one transmission 14 connected to power source 12 in a dual-path configuration.

Pump 18 and motor 20 may be variable displacement, variable delivery, fixed displacement, or any other configuration known in the art. Pump 18 may be directly connected to power source 12 via an input shaft 26. Alternatively, pump 18 may be connected to power source 12 via a torque converter, a gear box, an electrical circuit, or in any other manner known in the art. Pump 18 may be dedicated to supplying pressurized fluid only to motor 20, or alternatively may supply pressurized fluid to other hydraulic systems (not shown) within work machine 10.

Transmission 14 may also include an output shaft 21 connecting motor 20 to traction device 16. Work machine 10 may or may not include a reduction gear arrangement such as, for example, a planetary arrangement disposed between motor 20 and traction device 16.

Traction device 16 may include a track 24 located on each side of work machine 10 (only one side shown). Alternatively, traction device 16 may include wheels, belts or other driven traction devices. Traction device 16 may be driven by motor 20 to rotate in accordance with a rotation of output shaft 21.

Figure 2:
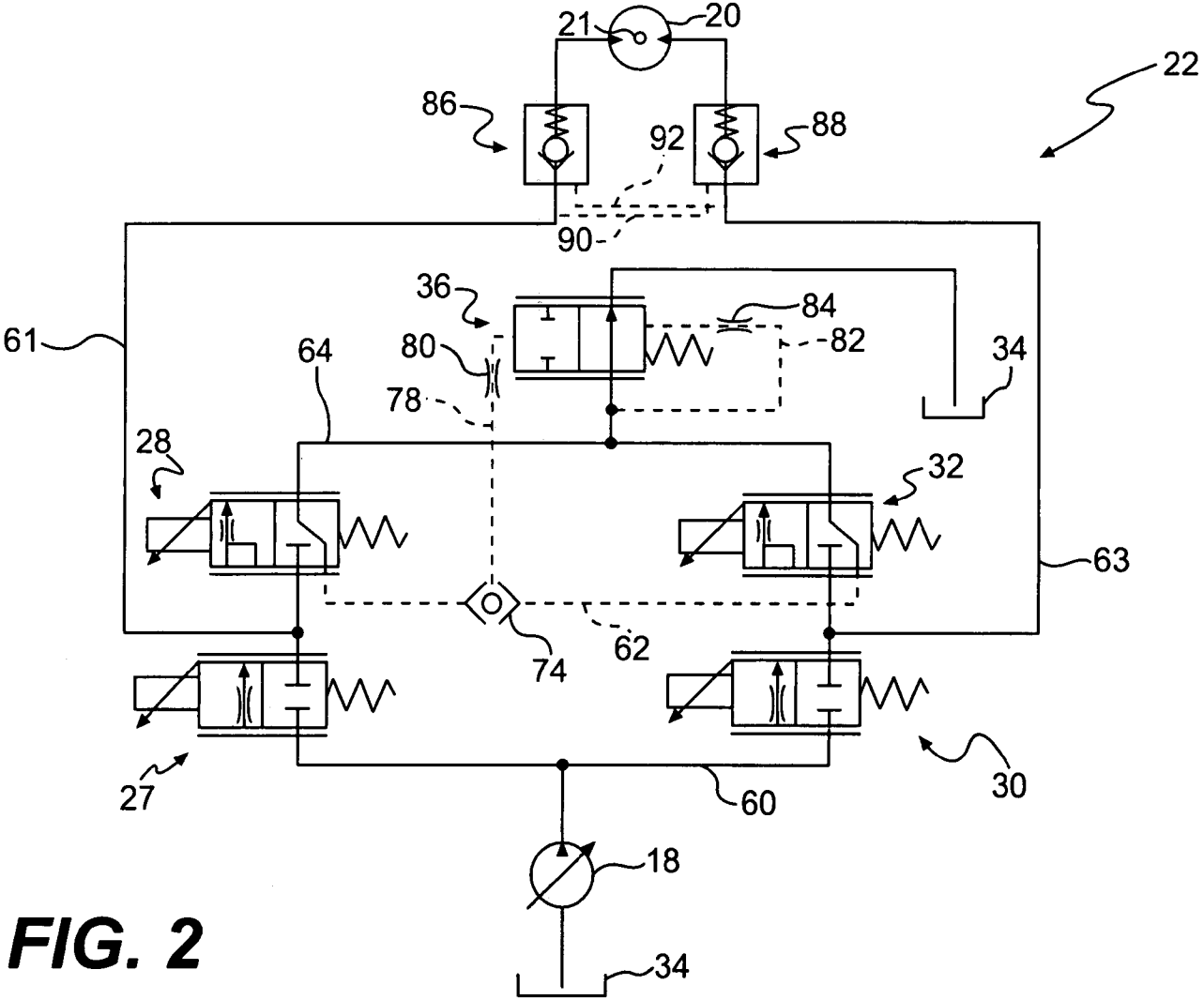
FIG. 2 is a schematic illustration of an exemplary disclosed hydraulic circuit for the work machine of FIG. 1.

As illustrated in FIG. 2, pump 18 and motor 20 may function within a hydraulic system 22 to move traction device 16 (referring to FIG. 1). Hydraulic system 22 may include, a forward supply valve 27, a reverse drain valve 28, a reverse supply valve 30, a forward drain valve 32, a tank 34, and a proportional pressure compensating valve 36. It is contemplated that hydraulic system 22 may include additional and/or different components such as, for example, pressure sensors, temperature sensors, position sensors, controllers, accumulators, make-up valves, relief valves, and other components known in the art. It is further contemplated that hydraulic system 22 may be associated with a hydraulic actuator other than or in addition to motor 20 such as, for example, a hydraulic cylinder.

Forward supply valve 27 may be disposed between pump 18 and motor 20 and configured to regulate a flow of pressurized fluid to motor 20 to assist in driving motor 20 in a forward direction. Specifically, forward supply valve 27 may include a spring-biased proportional valve mechanism that is solenoid-actuated and configured to move between a first position, at which fluid is allowed to flow into motor 20, and a second position, at which fluid flow is blocked from motor 20. It is contemplated that forward supply valve 27 may alternatively be hydraulically-actuated, mechanically-actuated, pneumatically-actuated, or actuated in any other suitable manner. It is further contemplated that forward supply valve 27 may be configured to allow fluid from motor 20 to flow through forward supply valve 27 during a regeneration event when a pressure within motor 20 exceeds a pressure directed to motor 20 from pump 18.

Reverse drain valve 28 may be disposed between motor 20 and tank 34 and configured to regulate a flow of pressurized fluid from motor 20 to tank 34 to assist in driving motor 20 in the forward direction. Specifically, reverse drain valve 28 may include a spring-biased proportional valve mechanism that is solenoid-actuated and configured to move between a first position, at which fluid is allowed to flow from motor 20, and a second position, at which fluid is blocked from flowing from motor 20. It is contemplated that reverse drain valve 28 may alternatively be hydraulically-actuated, mechanically-actuated, pneumatically-actuated, or actuated in any other suitable manner.

Reverse supply valve 30 may be disposed between pump 18 and motor 20 and configured to regulate a flow of pressurized fluid to motor 20 to assist in driving motor 20 in a reverse direction opposite the forward direction. Specifically, reverse supply valve 30 may include a spring-biased proportional valve mechanism that is solenoid-actuated and configured to move between a first position, at which fluid is allowed to flow into motor 20, and a second position, at which fluid is blocked from motor 20. It is contemplated that reverse supply valve 30 may alternatively be hydraulically-actuated, mechanically-actuated, pneumatically-actuated, or actuated in any other suitable manner. It is further contemplated that reverse supply valve 30 may be configured to allow fluid from motor 20 to flow through reverse supply valve 30 during a regeneration event when a pressure within motor 20 exceeds a pressure directed to reverse supply valve 30 from pump 18.

Forward drain valve 32 may be disposed between motor 20 and tank 34 and configured to regulate a flow of pressurized fluid from motor 20 to tank 34 to assist in driving motor 20 in the reverse direction. Specifically, forward drain valve 32 may include a spring-biased proportional valve mechanism that is solenoid-actuated and configured to move between a first position, at which fluid is allowed to flow from motor 20, and a second position, at which fluid is blocked from flowing from motor 20. It is also contemplated that forward drain valve 32 may alternatively be hydraulically-actuated, mechanically-actuated, pneumatically-actuated, or actuated in any other suitable manner.

Forward and reverse supply and drain valves 27, 28, 30, 32 may be fluidly interconnected. In particular, forward and reverse supply valves 27, 30 may be connected in parallel to an upstream common fluid passageway 60. Forward and reverse drain valves 32, 28 may be connected in parallel to a common signal passageway 62 and to a common drain passageway 64. Forward supply valve 27 and reverse drain valve 28 may be connected in parallel to a first motor passageway 61. Reverse supply valve 30 and forward drain valve 32 may be connected in parallel to a second motor passageway 63.

Hydraulic system 22 may include an additional component to control fluid pressures and flows within hydraulic system 22. Specifically, hydraulic system 22 may include a shuttle valve 74 disposed within common signal passageway 62. Shuttle valve 74 may be configured to fluidly connect the one of forward and reverse drain valves 32, 28 having a higher fluid pressure to proportional pressure compensating valve 36. Because shuttle valve 74 allows the higher pressure to affect proportional pressure compensating valve 36, proportional pressure compensating valve 36 may function to maintain constant drain flow and minimize voiding and/or overspeeding in response to an excessive pressure level in the motor caused by gravitation or inertial forces.

Tank 34 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 34. It is also contemplated that hydraulic system 22 may be connected to multiple separate fluid tanks.

Proportional pressure compensating valve 36 may be a hydro-mechanically-actuated proportional control valve disposed between common drain passageway 64 and tank 34 to control a pressure of the fluid exiting motor 20. Specifically, proportional pressure compensating valve 36 may include a valve element that is spring-biased and hydraulically-biased toward a flow passing position and movable by a hydraulic pressure differential toward a flow blocking position. In one embodiment, proportional pressure compensating valve 36 may be movable toward the flow blocking position by a fluid directed from shuttle valve 74 via a fluid passageway 78. A restrictive orifice 80 may be disposed within fluid passageway 78 to minimize pressure and/or flow oscillations within fluid passageway 78. Proportional pressure compensating valve 36 may be movable toward the flow passing position by a fluid directed via a fluid passageway 82 from a point immediately upstream of proportional pressure compensating valve 36 to an end of proportional pressure compensating valve 36. A restrictive orifice 84 may be disposed within fluid passageway 82 to minimize pressure and/or flow oscillations within fluid passageway 82. It is contemplated that the valve element of proportional pressure compensating valve 36 may alternatively be spring-biased toward a flow blocking position, that the fluid from fluid passageway 82 may alternatively bias the valve element of proportional pressure compensating valve 36 toward the flow passing position, and/or that the fluid from fluid passageway 78 may alternatively move the valve element of proportional pressure compensating valve 36 toward the flow blocking position. It is also contemplated that restrictive orifices 80 and 84 may be omitted, if desired.

Hydraulic system 22 may also include a backup for preventing overspeeding and voiding should either of first or second motor passageways 61, 63 rupture during operation of work machine 10. In particular, a first check valve 86 may be disposed within first motor passageway 61 adjacent motor 20, and a second check valve 88 may be disposed within second motor passageway 63 adjacent motor 20. A first signal passageway 90 may extend from first motor passageway 61 to second check valve 88, while a second signal passageway 92 may extend from second motor passageway 63 to first check valve 86. The pressure of the fluid within first signal passageway 90 or the pressure of the fluid within second motor passageway 63 may be sufficient to overcome the bias of a spring and back pressure associated with second check valve 88 to move second check valve 88 toward a flow passing position during normal operation. Similarly, the pressure of the fluid within second signal passageway 92 or the pressure of the fluid within first motor passageway 61 may be sufficient to overcome the bias of a spring and back pressure associated with first check valve 86 to move first check valve 86 toward a flow passing position during normal operation. During movement of the motor in the reverse direction, if second motor passageway 63 were to rupture, the pressure of the fluid within second signal passageway 92 may be insufficient to move first check valve 86 to the flow passing position. Similarly, during movement of the motor in the forward direction, if first motor passageway 61 were to rupture, the pressure of the fluid within first signal passageway 90 may be insufficient to move second check valve 88 to the flow passing position. When either of first or second check valves 86 and 88 are in a flow blocking position, motor 20 may be prevented from rotating.

INDUSTRIAL APPLICABILITY

The disclosed hydraulic system may be applicable to any work machine that includes a hydraulic actuator where voiding or overspeeding is undesired. The disclosed hydraulic system may provide high response pressure regulation that protects the components of the hydraulic system and provides consistent actuator performance in a low-cost, simple configuration. The operation of hydraulic system 22 will now be explained.

Motor 20 may be movable by fluid pressure in response to an operator input. Fluid may be pressurized by pump 18 and directed to forward and reverse supply valves 27 and 30. In response to an operator input to move traction device 16 in either a forward or reverse direction, the valve element of one of forward and reverse supply valves 27 and 30 may move to the open position to direct pressurized fluid to motor 20. Substantially simultaneously, the valve element of one of forward and reverse drain valves 32, 28 may move to the open position to direct fluid from motor 20 to tank 34 to create a pressure differential across motor 20 that causes motor 20 to rotate. For example, if a forward rotation of motor 20 is requested, forward supply valve 27 may move to the open position to direct pressurized fluid from pump 18 to motor 20. Substantially simultaneous to the directing of pressurized fluid to motor 20, forward drain valve 32 may move to the open position to allow fluid from motor 20 to drain to tank 34. If a reverse rotation of motor 20 is requested, reverse supply valve 30 may move to the open position to direct pressurized fluid from pump 18 to motor 20. Substantially simultaneous to the directing of pressurized fluid to motor 20, reverse drain valve 28 may move to the open position to allow fluid from motor 20 to drain to tank 34.

Because gravity may affect the rotation of motor 20 and the associated fluid flow out of motor 20, motor 20 may tend to overspeed or void during certain situations. For example, when traveling down an incline, gravity acting on work machine 10 may cause traction device to rotate motor 20 faster than intended. If left unregulated, these affects could result in inconsistent and/or unexpected motion of motor 20 and traction device 16, and could possibly result in shortened component life of hydraulic system 22. Proportional pressure compensating valve 36 may account for these affects by moving the valve element of proportional pressure compensating valve 36 between the flow passing and flow blocking positions in response to the pressure of fluid drained from motor 20 to provide a maximum acceptable pressure drop across motor 20.

As the valve element of one of forward and reverse drain valves 32, 28 is moved to the flow passing position, pressure of the signal fluid flowing through the flow passing valve to shuttle valve 74 may be higher than the pressure of the signal fluid flowing through the valve in the flow blocking position. As a result, the higher pressure may bias shuttle valve 74 to communicate the higher pressure from the flow passing valve to proportional pressure compensating valve 36. This higher pressure may then act against the force of the proportional pressure compensating valve spring and against the pressure from fluid passageway 82. The resultant force may then either move the valve element of proportional pressure compensating valve 36 toward the flow blocking or flow passing position. As the pressure of the fluid exiting motor 20 increases in response to a gravitational load, the valve element of proportional pressure compensating valve 36 may move toward the flow blocking position to restrict fluid flow from motor 20, thereby increasing the back pressure of motor 20 and maintaining an acceptable speed of motor 20. Similarly, as the pressure exiting motor 20 decreases, proportional pressure compensating valve 36 may move toward the flow passing position to thereby maintain the acceptable speed of motor 20. In this manner, proportional pressure compensating valve 36 may regulate the fluid pressure within hydraulic system 22 to minimize voiding and overspeeding.

Because proportional pressure compensating valve 36 is hydro-mechanically-actuated, pressure fluctuations within hydraulic system 22 may be quickly accommodated before they can significantly influence the motion of motor 20 or the component life of hydraulic system 22. In particular, the response time of proportional pressure compensating valve 36 may be about 200 hz or higher, which is much greater than typical solenoid-actuated valves that respond at about 5-15 hz. In addition, because proportional pressure compensating valve 36 may be hydro-mechanically-actuated rather than electronically-actuated, the cost of hydraulic system 22 may be minimized. Further, because hydraulic system 22 is not dependent upon sensory information, the complexity and component cost of hydraulic system 22 may be reduced.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a reservoir configured to hold a supply of fluid;

a source configured to pressurize the fluid;

a fluid actuator;

a first valve configured to selectively fluidly communicate the source with the fluid actuator to facilitate movement of the fluid actuator in a first direction;

a second valve configured to selectively fluidly communicate the fluid actuator with the reservoir to facilitate movement of the fluid actuator in the first direction;

a third valve configured to selectively fluidly communicate the fluid actuator with the reservoir to facilitate movement of the fluid actuator in a second direction;

a shuttle valve disposed between the second and third valves and movable between a first position where pressurized fluid from the second valve is passed through the shuttle valve, to a second position where pressurized fluid from the third valve is passed through the shuttle valve; and a proportional pressure compensating valve configured to control a pressure of the fluid directed between the fluid actuator and the reservoir.

2. The hydraulic system of claim 1, wherein the proportional pressure compensating valve includes a valve element movable toward a flow blocking position in response to a pressure of the fluid flowing through the second valve exceeding a predetermined pressure, thereby slowing the movement of the hydraulic actuator.

3. The hydraulic system of claim 1, wherein the hydraulic actuator is a motor.

4. The hydraulic system of claim 1, further including:

a fourth valve configured to selectively fluidly communicate the source with the fluid actuator to facilitate movement of the fluid actuator in the second direction.

5. The hydraulic system of claim 4, wherein each of the first, second, third, and fourth valves are solenoid-actuated control valves.

6. The hydraulic system of claim 4, further including a first fluid passageway disposed between the fluid actuator and the first and third valves; and a second fluid passageway disposed between the fluid actuator and the second and fourth valves.

7. The hydraulic system of claim 6, further including a first check valve disposed within the first fluid passageway and spring-biased to selectively prevent fluid flow from the fluid actuator to the first and third valves during movement of the fluid actuator in the first direction; and a second check valve disposed within the second fluid passageway and configured to selectively prevent fluid flow from the fluid actuator to the second and fourth valves during movement of the fluid actuator in the second direction.

8. The hydraulic system of claim 7, further including:

a first signal passageway configured to communicate the first fluid passageway and the second check valve; and a second signal passageway configured to communicate the second fluid passageway and the first check valve.

9. The hydraulic system of claim 4, further including a first fluid passageway disposed between the reservoir and the second and third valves, wherein the second and third valves are connected to the first fluid passageway in parallel and the proportional pressure compensating valve is disposed between the first fluid passageway and the reservoir.

10. The hydraulic system of claim 9, further including a first signal passageway, wherein the proportional pressure compensating valve includes a valve element movable between a flow passing position and a flow blocking position, and the first signal passageway is configured to direct fluid from between the proportional pressure compensating valve and the first fluid passageway to the proportional pressure compensating valve to bias the valve element toward one of the flow passing position and the flow blocking position.

11. The hydraulic system of claim 10, wherein the proportional pressure compensating valve includes a spring configured to bias the valve element toward one of the flow passing and flow blocking positions.

12. The hydraulic system of claim 4, further including:

a second signal passageway disposed upstream of the second and third valves, the second and third valves being in fluid communication with the second signal passageway, the shuttle valve being disposed within the second signal passageway.

13. The hydraulic system of claim 12, wherein the shuttle valve is movable in response to a fluid pressure.

14. The hydraulic system of claim 12, further including a third signal passageway configured to direct pressurized fluid from one of the second and third valves via the shuttle valve to the proportional pressure compensating valve to bias the proportional pressure compensating valve element toward the other of the flow passing and flow blocking position.

15. The hydraulic system of claim 1, wherein the first valve and the second valve are independently operable.

16. A method of operating a hydraulic circuit, comprising:

pressurizing a fluid;

directing the pressurized fluid to a fluid actuator via a first valve to facilitate movement of the fluid actuator in a first direction;

draining fluid from the fluid actuator via a second valve to facilitate movement of the fluid actuator in the first direction;

draining fluid from the fluid actuator via a third valve to facilitate movement in a second direction;

controlling a pressure of the fluid drained from the actuator with a proportional pressure compensating; and selectively preventing fluid flow from the fluid actuator to the first and third valves in response to a pressure differential across the fluid actuator exceeding a predetermined value during movement of the fluid actuator in the first direction.

17. The method of claim 16, wherein controlling a pressure includes moving a valve element of the proportional pressure compensating valve toward a flow blocking position in response to a pressure of the fluid flowing through the second valve exceeding a predetermined pressure, thereby slowing the movement of the hydraulic actuator.

18. The method of claim 16, further including:

directing the pressurized fluid to the fluid actuator via a fourth valve to facilitate movement in the second direction.

19. The method of claim 18, wherein each of the first, second, third, and fourth valves are solenoid-actuated control valves.

20. The method of claim 18, further including:

selectively preventing fluid flow from the fluid actuator to the second and fourth valves in response to a pressure differential across the fluid actuator exceeding a predetermined value during movement of the fluid actuator in the second direction.

21. The method of claim 20, further including directing a flow of pressurized fluid from an inlet of the fluid actuator to a check valve located at an exit of the fluid actuator to bias the check valve away from a seat.

22. The method of claim 18, further including:

directing a flow of pressurized fluid from immediately upstream of the proportional pressure compensating valve to an end of the proportional pressure compensating valve to urge a valve element of the proportional pressure compensating valve towards a flow passing position; and directing a flow of pressurized fluid from the second and third valves to an end of the proportional pressure compensating valve to urge a valve element of the proportional pressure compensating valve towards a flow blocking position.

23. The method of claim 16, wherein the first valve and the second valve are independently operable.

24. A machine, comprising:

a power source;

a traction device;

a hydraulic motor connected to move the traction device, thereby propelling the machine;

a reservoir configured to hold a supply of fluid;

a source driven by the power source to pressurize the fluid;

a first valve configured to selectively fluidly communicate the source with the hydraulic motor to facilitate movement of the traction device in a first direction;

a second valve configured to selectively fluidly communicate the hydraulic motor with the reservoir to facilitate movement of the traction device in the first direction;

a third valve configured to selectively fluidly communicate the hydraulic motor with the reservoir to facilitate movement of the traction device in a second direction;

a shuttle valve disposed between the second and third valves and movable between a first position where pressurized fluid from the second valve is passed through the shuttle valve, to a second position where pressurized fluid from the third valve is passed through the shuttle valve, wherein the shuttle valve is movable in response to a fluid pressure; and a proportional pressure compensating valve configured to control a pressure of a fluid directed between the hydraulic motor and the reservoir.

25. The machine of claim 24, wherein the proportional pressure compensating valve includes a valve element movable toward a flow blocking position in response to a pressure of the fluid flowing through the second valve exceeding a predetermined pressure, thereby slowing the movement of the traction device.

26. The machine of claim 24, further including:

a fourth valve configured to selectively fluidly communicate the source with the hydraulic motor to facilitate movement of the traction device in the second direction.

27. The machine of claim 26, wherein each of the first, second, third, and fourth valves are solenoid-actuated control valves.

28. The machine of claim 26, further including a first fluid passageway disposed between the hydraulic motor and the first and third valves; and a second fluid passageway disposed between the hydraulic motor and the second and fourth valves.

29. The machine of claim 28, further including a first check valve disposed within the first fluid passageway and spring-biased to selectively prevent fluid flow from the hydraulic motor to the first and third valves during movement of the hydraulic motor in the first direction; and a second check valve disposed within the second fluid passageway and configured to selectively prevent fluid flow from the hydraulic motor to the second and fourth valves during movement of the hydraulic motor in the second direction.

30. The machine of claim 29, further including:

a first signal passageway configured to communicate the first fluid passageway and the second check valve; and a second signal passageway configured to communicate the second fluid passageway and the first check valve.

31. The machine of claim 26, further including a first fluid passageway disposed between the reservoir and the second and third valves, wherein the second and third valves are connected to the first fluid passageway in parallel and the proportional pressure compensating valve is disposed between the first fluid passageway and the reservoir.

32. The machine of claim 31, further including a first signal passageway, wherein the proportional pressure compensating valve includes a valve element movable between a flow passing position and a flow blocking position, and the first signal passageway is configured to direct fluid from between the proportional pressure compensating valve and the first fluid passageway to the proportional pressure compensating valve to bias the valve element toward one of the flow passing position and the flow blocking position.

33. The machine of claim 26, further including:

a second signal passageway disposed upstream of the second and third valves, the second and third valves being in fluid communication with the second signal passageway, the shuttle valve being disposed within the second signal passageway.

34. The machine of claim 33, further including a third signal passageway configured to direct pressurized fluid from one of the second and third valves via the shuttle valve to the proportional pressure compensating valve to bias the proportional pressure compensating valve element toward the other of the flow passing and flow blocking position.

35. The work machine of claim 24, wherein the first valve and the second valve are independently operable.

* * * * *